US008131188B2

(12) United States Patent
Takagi

(10) Patent No.: US 8,131,188 B2
(45) Date of Patent: Mar. 6, 2012

(54) DEVELOPER CONTAINER

(75) Inventor: Takeyuki Takagi, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 972 days.

(21) Appl. No.: 12/058,048

(22) Filed: Mar. 28, 2008

(65) Prior Publication Data

US 2008/0239868 A1 Oct. 2, 2008

(30) Foreign Application Priority Data

Mar. 28, 2007 (JP) ..... 2007-083631

(51) Int. Cl.
*G03G 15/08* (2006.01)

(52) U.S. Cl. ..... 399/262; 399/120

(58) Field of Classification Search ..... 399/262, 399/258, 120
See application file for complete search history.

(56) References Cited

U.S. PATENT DOCUMENTS 6,324,371 B1 11/2001 Okiyama et al.
(Continued)

FOREIGN PATENT DOCUMENTS

EP 1220050 A 3/2002
(Continued)

OTHER PUBLICATIONS

JP Office Action dtd Jun. 7, 2011, JP Application No. 2007-083631; English Translation.

*Primary Examiner* — Sophia S Chen
(74) *Attorney, Agent, or Firm* — Banner & Witcoff, Ltd.

(57) ABSTRACT

A developer container is provided. The developer container includes a first housing having an agitating member; and a second housing covering the first housing and being rotatable around the agitating member relative to the first housing. The first housing includes a first cylinder portion that has a first opening; and a first end portion that extends substantially perpendicular to the shaft. The second housing includes a first cover member that covers a part of the first housing; and a second cover member that is separated from the first cover member and covers a remaining part of the first housing. The first cover member includes a first cover cylinder portion that has a second opening corresponding to the first opening; and a first cover end portion provided at each end. The second cover member includes a second cover cylinder portion; and a second cover end portion provided at each end.

23 Claims, 10 Drawing Sheets

U.S. PATENT DOCUMENTS

| | | | | |
|---|---|---|---|---|
| 7,450,890 | B2 * | 11/2008 | Murakami et al. | 399/258 |
| RE40,711 | E | 5/2009 | Okiyama et al. | |
| 7,555,251 | B2 * | 6/2009 | Sato | 399/262 |
| 7,606,519 | B2 * | 10/2009 | Mihara | 399/258 |
| 7,647,005 | B2 * | 1/2010 | Takagi | 399/120 X |
| 7,742,725 | B2 * | 6/2010 | Mase et al. | 399/258 |
| 7,899,344 | B2 * | 3/2011 | Mase | 399/258 X |
| 2006/0104671 | A1 | 5/2006 | Murakami et al. | |
| 2006/0182469 | A1 * | 8/2006 | Koyama et al. | 399/258 |

FOREIGN PATENT DOCUMENTS

| | | | | |
|---|---|---|---|---|
| JP | 56-140377 | A | | 11/1981 |
| JP | 59-204063 | | | 11/1984 |
| JP | 60-121473 | | | 6/1985 |
| JP | 60-125866 | | | 7/1985 |
| JP | 60-146271 | | | 8/1985 |
| JP | 62-016964 | U | | 1/1987 |
| JP | 62-035383 | | | 2/1987 |
| JP | 04-110877 | | | 4/1992 |
| JP | 04-220668 | | | 8/1992 |
| JP | 05-273853 | | | 10/1993 |
| JP | 10-293460 | | | 11/1998 |
| JP | 11-258898 | A | | 9/1999 |
| JP | 11-272053 | A | * | 10/1999 |
| JP | 2001-042620 | A | | 2/2001 |
| JP | 2002-258595 | A | | 9/2002 |
| JP | 2003-029515 | | | 1/2003 |
| JP | 2006-163374 | A | | 6/2006 |
| JP | 2007-101931 | A | * | 4/2007 |

* cited by examiner

DEVELOPER CONTAINER

CROSS-REFERENCE TO RELATED APPLICATIONS

This application claims priority from Japanese Patent Application No. 2007-083631 filed on Mar. 28, 2007, the entire subject matter of which is incorporated herein by reference.

TECHNICAL FIELD

Aspects of the present invention relate to a developer container that contains a developer.

BACKGROUND

JP-A-10-293460 proposes a related art process cartridge that has a developing roller and can be attached to and detached from an image forming apparatus. Such a related art process cartridge includes a process body including the developing roller and a related art developer container that can be attached to and detached from the process body. The developer container contains a developer therein and supplies the developer to the process body. The related art developer container includes a developer supply port formed in a container body and a supply port shielding member for opening and closing the developer supply port so as to supply the developer to the process body.

SUMMARY

Aspects of the present invention relate to a developer container which can maintain the strength of the developer container and facilitate the manufacturing thereof.

DETAILED DESCRIPTION

<General Overview>

Figure 1:
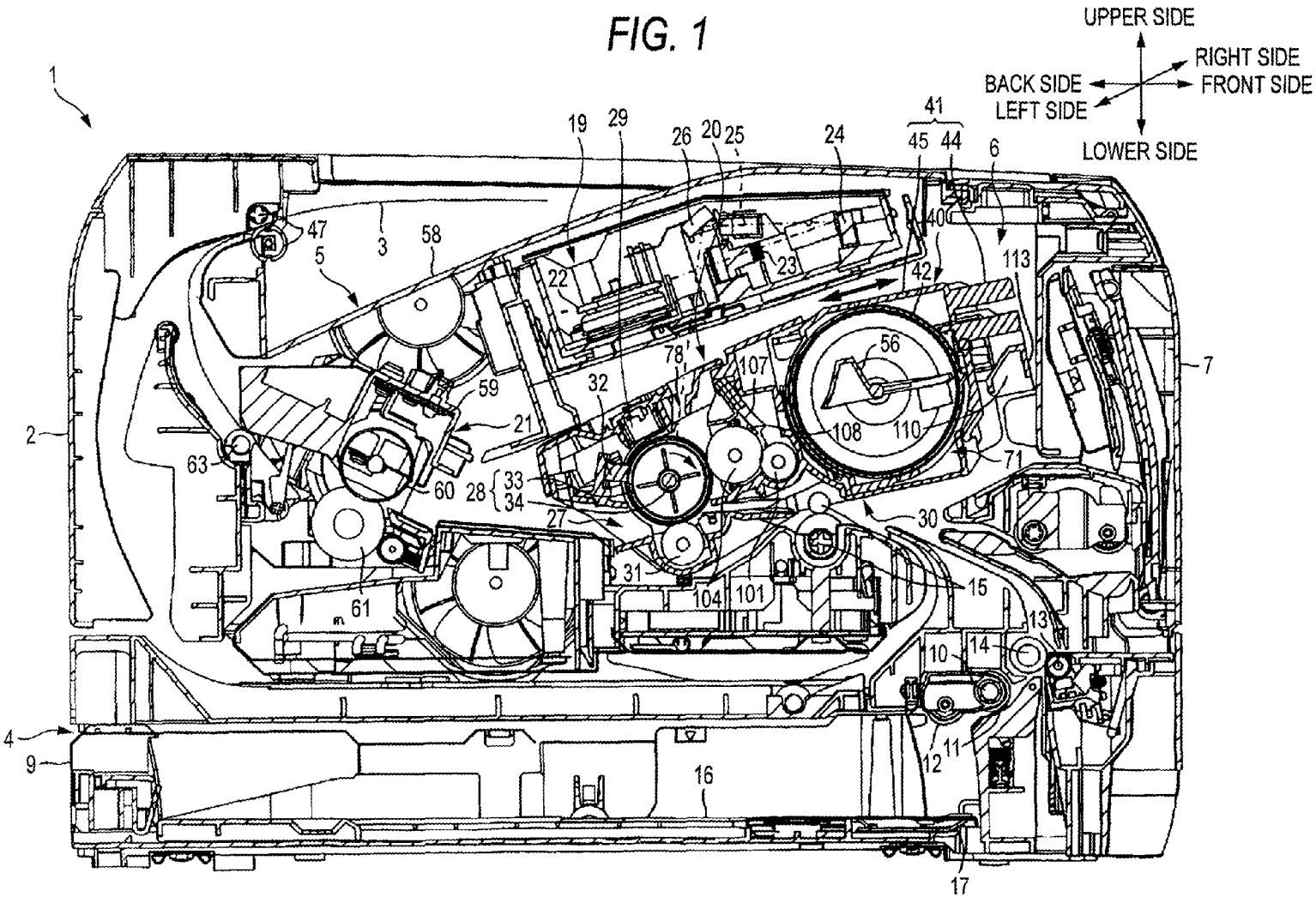
FIG. 1 is an exemplary side sectional view of an image forming apparatus according to an illustrative aspect of the present invention.

According to an aspect of the present invention, there is provided a developer container including a first housing that accommodates an agitating member and that has a substantially cylindrical shape along a shaft of the agitating member; and a second housing that covers the first housing and is rotatable around the shaft of the agitating member relative to the first housing, wherein the first housing includes a first cylinder portion that extends along the shaft of the agitating member and that has a first opening; and a first end portion that extends substantially perpendicular to the shaft of the agitating member at both ends of the first cylinder portion, wherein the second housing includes a first cover member that covers a part of the first housing in a direction perpendicular to the shaft of the agitating member; and a second cover member that is separated from the first cover member and covers a remaining part of the first housing in the direction perpendicular to the shaft of the agitating member, wherein the first cover member includes a first cover cylinder portion that extends along the first cylinder portion and that has a second opening corresponding to the first opening; and a first cover end portion provided at each end of the first cover cylinder portion, the first cover end portion extending in the direction perpendicular to the shaft of the agitating member, and wherein the second cover member includes a second cover cylinder portion that extends along the first cylinder portion; and a second cover end portion provided at each end of the second cover cylinder portion, the second cover end portion extending in the direction perpendicular to the shaft of the agitating member.

According to another aspect of the present invention, there is provided a developer container including a first housing that includes an agitating member and that has a substantially cylindrical shape along a shaft of the agitating member; and a second housing that includes a housing section for housing the first housing and is rotatable around the shaft of the agitating member relative to the first housing, wherein the first housing includes a first cylinder portion that has a first opening formed therein and that extends along the shaft of the agitating member; and a first end portion that extends perpendicular to the shaft of the agitating member at each end of the first cylinder portion, wherein the second housing includes a first cover member that covers a part of the first housing in a direction perpendicular to the shaft of the agitating member; and a second cover member that covers a remaining part of the first housing in the direction perpendicular to the shaft of the agitating member, wherein the first cover member includes a first cover cylinder portion that has a second opening corresponding to the first opening and the second opening extends along the first cylinder portion; and a first cover end portion that extends in the direction perpendicular to the shaft of the agitating member at each end of the first cover cylinder portion, wherein the second cover member includes a second cover cylinder portion that extends along the first cylinder portion; and a second cover end portion that extends in the direction perpendicular to the shaft of the agitating member at each end of the second cover cylinder portion, wherein the first cover cylinder portion includes a first edge portion that extends along the shaft of the agitating member, wherein the second cover cylinder portion includes a second edge portion that extends along the shaft of the agitating member and is connected to the first edge portion, and wherein the first cover member and the second cover member are capable of opening and closing about the first housing.

<Illustrative Aspects>

Illustrative aspects of the present invention will be described with reference to the drawings.

In the related art developer container has a disadvantage in that it is difficult to fit the supply port shielding member to the container body while maintaining the strength of the supply port shielding member.

Aspects of the present invention relate to a developer container that can maintain the strength of the developer container and facilitate the manufacturing thereof. (First Illustrative Aspect)

FIG. 1 is an exemplary side sectional view of an image forming apparatus according to an illustrative aspect of the present invention.

As shown in FIG. 1, the image forming apparatus 1 includes a body casing 2 as a main body of the image forming apparatus, a feeder unit 4 for feeding a sheet 3, and an image forming unit 5 for forming an image on the fed sheet 3, which are housed in the body casing 2.

(1) Body Casing

An attachment and detachment port 6 as an opening for allowing a process unit 20 to pass therethrough at a time of attaching and detaching the process unit 20 to be described later is formed in a side wall of the body casing 2. A front cover 7 is provided as a cover for covering the attachment and detachment port 6 so as to open and close the attachment and detachment port 6.

In the following description, in a state where the process unit 20 is attached to the body casing 2, a side on which the front cover 7 is disposed is referred to as a front side and the opposite side thereof is referred to as a back side (rear side). A side going out of the paper surface in FIG. 1 is referred to as a left side and a side going into the paper surface in FIG. 1 is referred to as a right side. The left and right directions may be called a width direction.

The front cover 7 is pivotally supported by the body casing 2. When the front cover 7 is closed, the attachment and detachment port 6 is closed by the front cover 7. When the front cover 7 is opened, the attachment and detachment port 6 is opened. The process unit 20 can be attached to and detached from the body casing 2 through the attachment and detachment port 6.

(2) Feeder Unit

The feeder unit 4 is disposed on the bottom of the body casing 2 and includes a sheet feeding tray 9, a separation roller 10, a separation pad 11, a feed roller 12, a sheet powder removing roller 13, a pinch roller 14, and a register roller 15.

The sheet feeding tray 9 includes a sheet pressing plate 16 disposed therein and a lever 17 disposed at the front end thereof. The front end of the sheet pressing plate 16 is raised upward by the lever 17.

A sheet 3 placed on the sheet pressing plate 16 is conveyed to a separation position between the separation roller 10 and the separation pad 11 with the rotation of the feed roller 12, is processed at the separation position sheet by sheet, passes between the sheet powder removing roller 13 and the pinch roller 14, and is then conveyed to the register roller 15.

The sheet 3 conveyed to the register roller 15 is conveyed to a transfer position between a photosensitive drum 28 as an image holding member to be described later and a transfer roller 31.

(3) Image Forming Unit

The image forming unit 5 includes a scanner unit 19, a process unit 20, and a fixing unit 21.

(a) Scanner Unit

The scanner unit 19 is disposed on an upper side of the body casing 2 and includes a laser source (not shown), a polygon mirror 22 to be rotationally driven, a fθ lens 23, a reflecting mirror 24, a lens 25, and a reflecting mirror 26. A laser beam emitted from the laser source and based on image data is deflected to the polygon mirror 22 as indicated by a chained line, passes through the fθ lens 23, and is turned back in an optical path by the reflecting mirror 24. Then, the laser beam passes through the lens 25 and is bent downward in the optical path by the reflecting mirror 26, whereby the laser beam is applied to the surface of the photosensitive drum 28 of the process unit 20.

(b) Process Unit

As shown in FIG. 1, the process unit 20 is disposed below the scanner unit 19 of the body casing 2 and is detachably attached to the body casing 2 through the attachment and detachment port 6. The attachment and detachment direction of the process unit 20 relative to the body casing 2 is a lower back direction (attachment direction) and an upper front direction (detachment direction), as indicated by a solid arrow.

Figure 3:
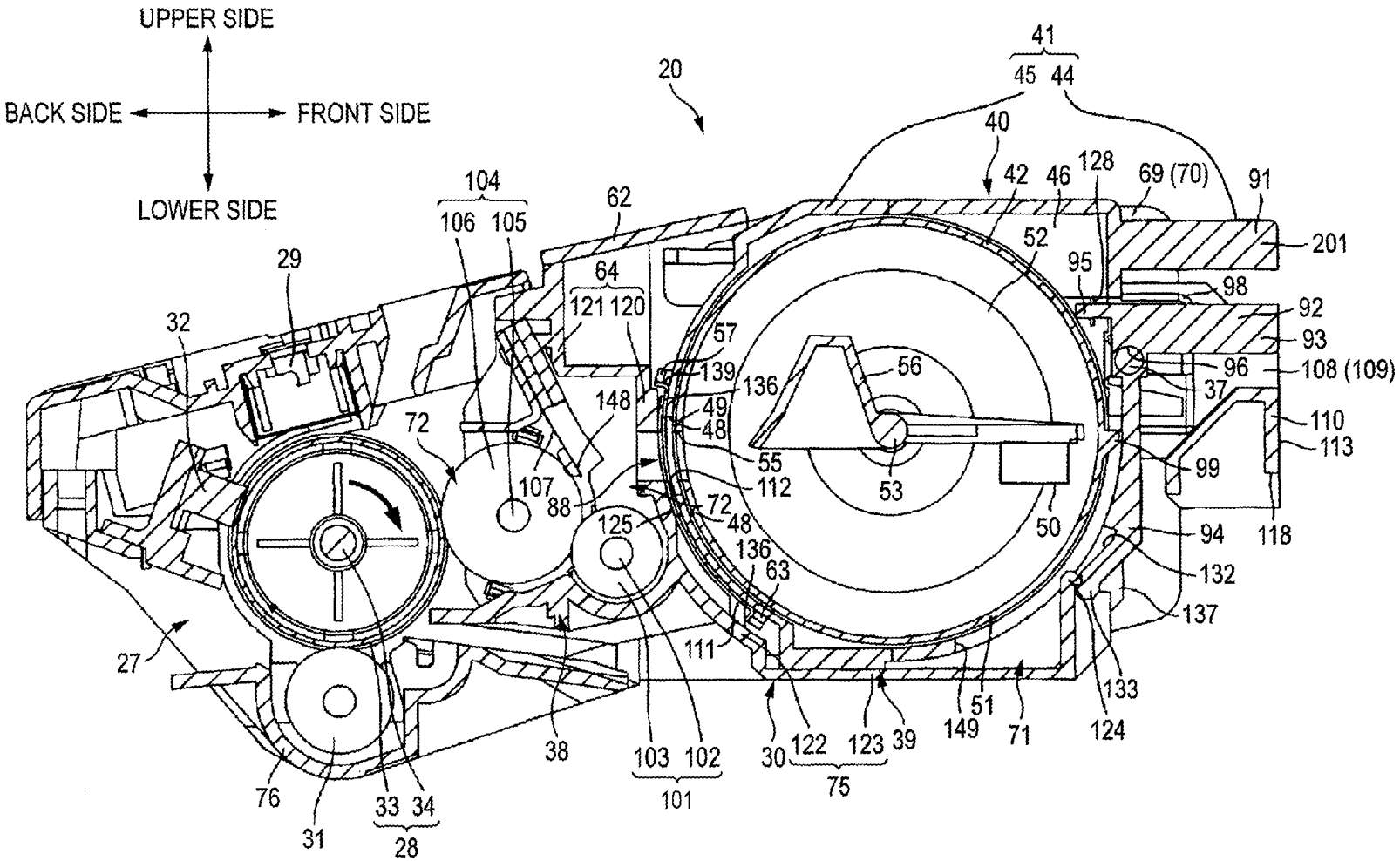
FIG. 3 is an exemplary left sectional view of the process unit of FIG. 2.

As shown in FIG. 3, the process unit 20 includes a drum section 27 forming a back half section and a developing section 30 as a unit body section forming a front half section and further includes a developer container 40 which is detachably attached to the developing section 30.

(b-1) Drum Section

The drum section 27 includes a drum housing 76, a photosensitive drum 28 disposed inside the drum housing 76, a scorotron-type charger 29, a transfer roller 31, and a cleaning brush 32.

The photosensitive drum 28 has a substantially cylinder shape and includes a drum body 33 formed of a positive-charged photosensitive layer of which the uppermost layer is made of polycarbonate or the like and a metal drum shaft 34 extending along the shaft direction of the drum body 33 at the center of the drum body 33.

The scorotron-type charger 29 is supported by the drum housing 76 on the upper back side of the photosensitive drum 28 and is opposed to the photosensitive drum 28 with a gap so as not to come in contact with the photosensitive drum 28.

The scorotron-type charger 29 charges the surface of the photosensitive drum 28 to be uniformly positive by the use of the corona discharge.

The transfer roller 31 is disposed below the photosensitive drum 28 in the drum housing 76 and comes in vertical contact with the photosensitive drum 28 to form a nip between the photosensitive drum 28 and the transfer roller 31. The nip is a transfer position between the photosensitive drum 28 and the transfer roller 31. The transfer roller 31 includes a metal roller shaft and a rubber roller made of a conductive rubber material so as to cover the roller shaft. A transfer bias is applied to the transfer roller at the time of transfer.

The cleaning brush 32 is disposed to come in contact with the photosensitive drum 28 on the upper back side of the photosensitive drum 28 and on the lower back side of the scorotron-type charger 29 in the drum housing 76.

(b-2) Developing Section

The developing section 30 forms a body along with the drum section 27 in the drum housing 76.

The developing section 30 includes a developing housing 62 and a feed roller 101, a developing roller 104 as a developer holding member, and a thickness regulating blade 107, which are disposed in the developing housing 62.

The developing housing 62 integrally includes a back housing 38 that has a substantially longitudinal box shape which is long in the width direction of which the back side is opened and a front housing 39 of which the up side and front side are opened and which has a width larger than that of the back housing 38.

A developing front wall 64 is formed in the back housing 38 and a developing chamber 72 for housing the feed roller 101, the developing roller 104, and the thickness regulating blade 107 is disposed therein.

The feed roller 101 is disposed on the lower back side of a developer introduction port 88 to be described later. The feed roller 101 includes a metal feed roller shaft 102 and a sponge roller 103 made of a conductive foamed material to cover the feed roller shaft 102.

The developing roller 104 is disposed in the back of the feed roller 101 in a state where it is in pressed contact with the feed roller 101. The developing roller 104 includes a metal developing roller shaft 105 which is long in the width direction and a rubber roller 106 made of a conductive rubber material to cover the developing roller shaft 105. A developing bias is applied to the developing roller 104 at the time of developing.

The thickness regulating blade 107 is formed of a metal leaf spring member and has at its free end a pressing portion 148 having a substantially semi-circular section and made of insulating or conductive silicon rubber or urethane rubber. A base of the thickness regulating blade 107 is supported by the back housing 38 above the developing roller 104, whereby the pressing portion 148 comes in pressed contact with the developing roller 104 by means of an elastic force of the thickness regulating blade 107.

The developing front wall 64 is disposed in the front of the back housing 38 and integrally includes a vertical wall 120 and a upwardly bent wall 121 that is bent from the upper edge of the vertical wall 120 to the back side and that is then bent upward again, thereby forming a substantially L shape as viewed from the left.

The front housing 39 includes a right side wall 69 (see FIG. 2), a left wall 70 (see FIG. 2), and a developing front bottom wall 75.

The developing front bottom wall 75 has a substantially C shape as viewed from the end surface and integrally includes a curved wall 122 forming a back half portion and an L-shaped wall 123 forming a front half portion.

The curved wall 122 has a side section that has a substantially arc shape. The front edge of the curved wall 122 is connected to the back edge of the L-shaped wall 123.

Figure 8:
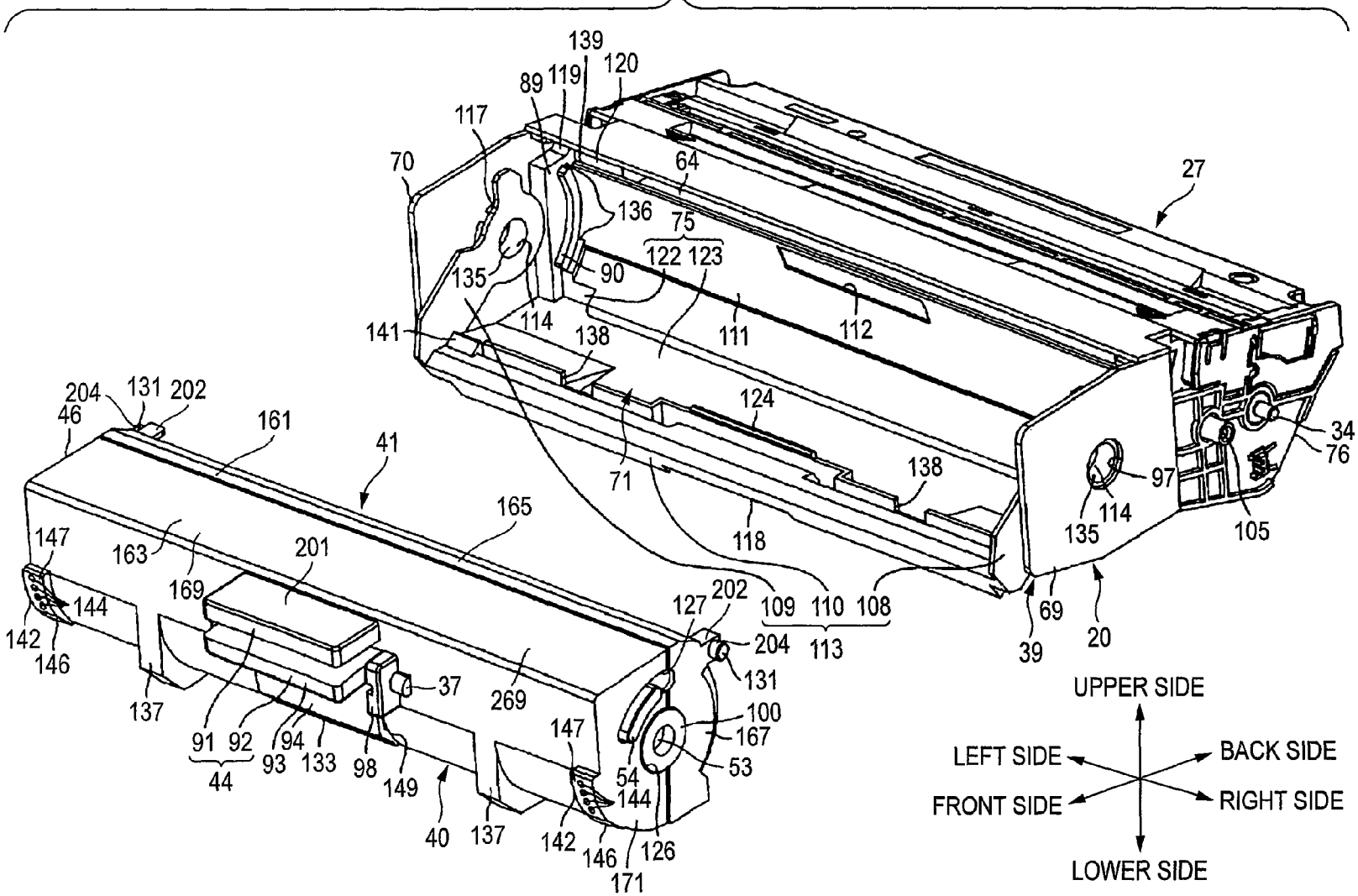
FIG. 8 is an exemplary perspective view showing a state where the developer container is detached from the process unit of FIG. 2, and the switching lever is located at the release position.

The L-shaped wall 123 extends forward from the back edge, is then bent, and extends upward, thereby forming a substantially L shape in the side section thereof. An inactive engaging portion 124 having a hook shape in a side section thereof and being bent at the upper edge thereof and extending slightly forward is integrally formed at the centers of the front end portion and the upper end portion of the L-shaped wall 123 in the width direction. As shown in FIG. 8, in the front half portion of the L-shaped wall 123, positioning grooves 138 recessed downward from the upper edge of the front end of the L-shaped wall 123 are formed at positions apart from the center in the width direction to the outside in the width direction by a distance corresponding to about ¼ of the width of the L-shaped wall 123.

Figure 2:
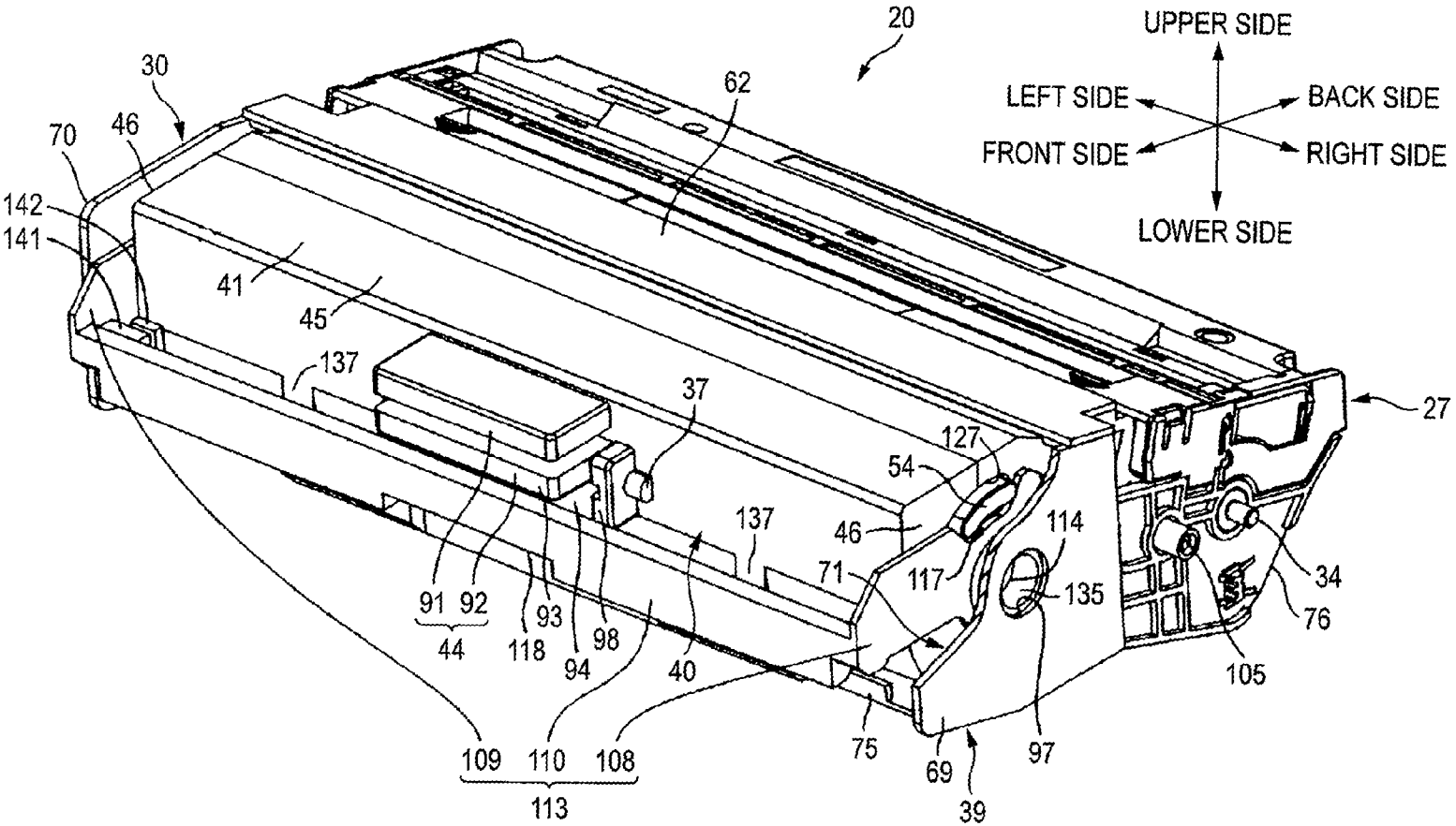
FIG. 2 is an exemplary right perspective view of a process unit of the image forming apparatus of FIG. 1, according to an illustrative aspect of the present invention, as viewed from an upper front side of the image forming apparatus.

As shown in FIG. 2, the right side wall 69 and the left side wall 70 are opposed to each other with the developing front bottom wall 75 interposed therebetween in the width direction and have a substantially rectangular shape in a side view. In FIG. 2, the upper front portion of the right side wall 69 is notched for the purpose of convenient explanation.

Figure 4A:
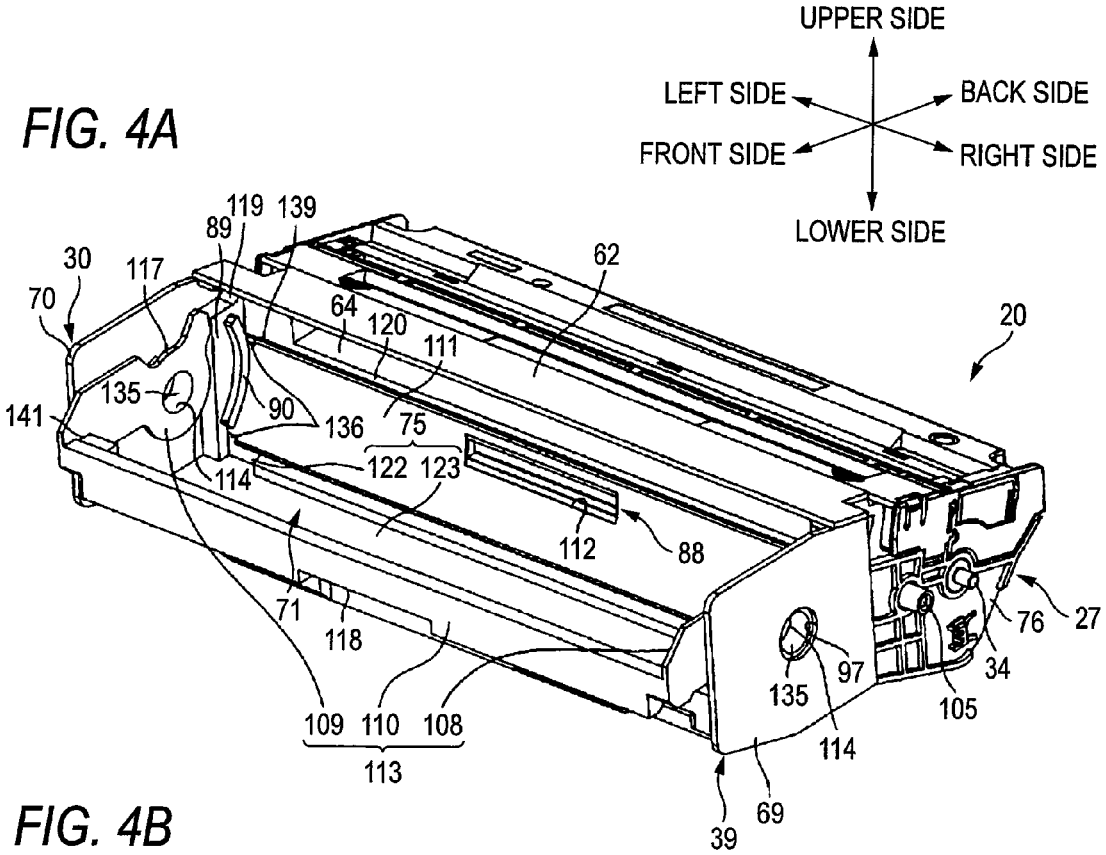
FIG. 4A shows a schematic view of the process unit of FIG. 2, in which a developer container is detached and a switching lever is located at a contact position and a developer introduction port is opened.

First insertion holes 97 penetrating the right side wall 69 and the left side wall 70 in the width direction are formed at the center positions in the vertical direction of the right side wall 69 and the left side wall 70. As shown in FIG. 4A, prisms 89 are formed integrally at the back ends in the width direction of the right side wall 69 and the left side wall 70, respectively.

The prisms 89 have a substantially rectangular parallelepiped shape which is longitudinal in the vertical direction and have a guide groove 119 formed at its upper end by recessing the front end surface backward. A rib 90 is formed integrally in the inner surface in the width direction of each prism 89 below the guide groove 119. The rib 90 protrudes inward in the width direction so that the side section has a substantially arc shape and is disposed with a slight gap between the curved wall 122 and the rib in the diameter direction thereof substantially along the curved wall 122 of the developing front bottom wall 75.

In the front housing 39, a portion defined by the right side wall 69, the left side wall 70, and the developing front bottom wall 75 serves as a developer container housing chamber 71 for housing the developer container 40. The developer container housing chamber 71 has a substantially bottomed frame shape of which the upper side and the front side are opened.

The back housing 38 and the front housing 39 are connected to each other through the front surface of the vertical wall 120 of the developing front bottom wall 64 and the back surface of the curved wall 122 of the developing front bottom wall 75. A developer introduction port 88 penetrating the vertical wall 120 and the curved wall 122 in the thickness direction is formed at the center position in the width direction of the connected portion between the vertical wall 120 and the curved wall 122. The developer introduction port 88 has a substantially rectangular shape which is longitudinal in the width direction. The developer container housing chamber 71 and the developing chamber 72 communicate with each other through the developer introduction port 88.

The developer container housing chamber 71 includes a shutter 111 as a process shielding member and a switching lever 113 as a revolving member.

Figure 4B:
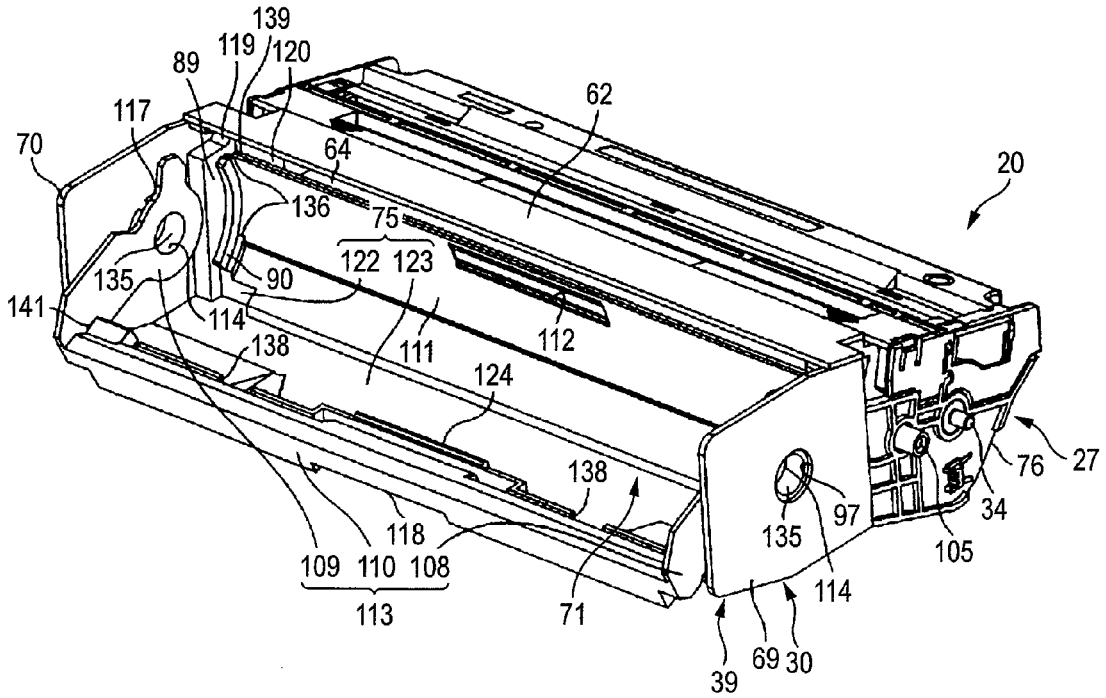
FIG. 4B shows a schematic view of the process unit of FIG. 2, in which the developer container is detached and the switching lever is located at a release position and the developer introduction port is closed.

As shown in FIG. 3, the shutter 111 is a thin plate having a substantially arc shape in which a circumferential length is slightly smaller than that of the curved wall 122 in a side section thereof. As shown in FIG. 4B, a through hole 112 penetrating the shutter 111 in the thickness direction and having a substantially rectangular shape as viewed from the front is formed at the center position in the width direction of the upper half portion. Notched portions 136 notched in a substantially L shape as viewed from the front are formed at the upper end portion and the lower end portion of both ends in the width direction of the shutter 111. Inactive engaging portions 139 engaging with second diameter wise protrusions 57 of the developer container 40 in a state where the developer container 40 is attached to the process unit 20 are formed in portions more inward in the width direction from the notched portions 136 in the upper end of the shutter 111.

As shown in FIGS. 4A and 4B, inside the developer container housing chamber 71, the shutter 111 is rotationally supported along the side sectional shape of the ribs 90 by inserting both ends in the width direction of the shutter 111 between the curved wall 122 and the ribs 90 of the prisms 89.

The shutter 111 can move to a developing closing position (see FIG. 4B) where the developer introduction port 88 is closed in a portion of the shutter 111 not having the through hole 112 formed therein and a developing opening position (see FIG. 4A) where the developer introduction port 88 is opened forward by allowing the through hole 112 and the developer introduction port 88 to be opposed to each other.

Returning to FIG. 3, a sealing member 125 is interposed between the curved wall 122 and the shutter 111. The sealing member 125 has, for example, a substantially sheet shape made of felt or the like and is attached to the front surface of the curved wall 122 so as not to close the developer introduction port 88.

As shown in FIG. 4A, the switching lever 113 has a substantially U shape in a plan view and includes a right supporting portion 108, a left supporting portion 109, and a process unit side grip portion 110 as a contact member in a bundle.

The left supporting portion 108 and the right supporting portion 109 have a thin plate shape having a substantially P shape as viewed from the right. Circular openings 114 penetrating the right supporting portion 108 and the left supporting portion 109 in the thickness direction are formed at the center positions of the back halves of the right supporting portion 108 and the left supporting portion 109, respectively.

In the outer side surfaces in the width direction of the right supporting portion 108 and the left supporting portion 109, supporting cylinders 135 having the same inner diameter as the circular openings 114 are formed at positions corresponding to the circular openings 114 and protrude outward in the width direction. The outer diameter of the supporting cylinders 135 is slightly smaller than the inner diameter of the first insertion holes 97 of the right side wall 69 and the left side wall 70.

Receiving portions 117 having a substantially U shape as viewed from the side by recessing the upper edge toward the circular openings 114 are formed above the circular openings 114 of the right supporting portion 108 and the left supporting portion 109.

The process unit side grip portion 110 is suspended between the right supporting portion 108 and the left supporting portion 109 and is formed of a thin plate having a substantially rectangular shape as viewed from the front. A handle portion 118 of which the lower edge is recessed upward is formed at the center position of the grip portion in the width direction. Contact protrusions 141 having a substantially rectangular parallelepiped shape protruding toward the circular opening 114 are formed at both ends in the width direction close to the circular openings 114. A contact portion not shown but having a substantially convex shape toward the circular openings 114 (backward) is disposed at a side surface (back surface) of each contact protrusion 141 close to the circular opening 114. The contact portions have, for example, a substantially semi-spherical shape so as to be fitted to inactive contact portions 144 (see FIG. 8) of the developer container 40 to be described later.

As shown in FIG. 4A, the switching lever 113 is rotatably supported by the right side wall 69 and the left side wall 70 by allowing the supporting cylinders 135 of the right supporting portion 108 and the left supporting portion 109 to be inserted into the first insertion holes 97 of the right side wall 69 and the left side wall 70. The switching lever 113 can revolve between a release position (see FIG. 4B) where the process unit side grip portion 110 of the switching lever 113 is located below the circular opening 114 and a contact position (see FIG. 4A) where the process unit side grip portion 110 is located at the same vertical level as the circular opening 114. The release position is lower than the contact position. In the state shown in FIG. 4B, that is, in the state where the developer container 40 is not attached to the developing section 30, the switching lever 113 is located at the release position with its self weight.

As shown in FIG. 3, the handle portion 118 is exposed outside the developer container housing chamber 71 as viewed from the side, regardless of the position of the switching lever 113.

Returning to FIG. 3, the drum section 27 and the developing section 30 are fitted to each other by fitting the front end of the drum housing 76 to the back end of the back housing 38.

(b-3) Developer Container

The developer container 40 is detachably attached to the developer container housing chamber 71 of the developing section 30 as described above. Referring to FIG. 1, the developer container 40 can be attached to or detached from the body casing 2 by attaching or detaching the process unit 20 to or from the body casing 2 through the attachment and detachment port 6 in a state where it is attached to the process unit 20. The attachment and detachment directions in which the developer container 40 is attached to and detached from the developer container housing chamber 71 of the process unit 20 are the same as the attachment and detachment directions in which the process unit 20 is attached to and detached from the body casing 2, that is, the lower back direction (attachment direction) and the upper front direction (detachment direction). The direction perpendicular to the attachment and detachment directions of the developer container 40 with respect to the developer container housing chamber 71 is the width direction.

The developer container housing chamber 71 is located to the front of the process unit 20. Accordingly, the developer container 40 is exposed from the attachment and detachment port 6 by opening the front cover 7 and opening the attachment and detachment port 6, as shown in FIG. 1.

As shown in FIG. 3, the developer container 40 has a substantially σ shape as viewed from the left and includes an inner housing 42 as an example of the first housing and an outer housing 41 as an example of the second housing, which are formed of resin.

(b-3-i) Inner Housing

Figure 6:
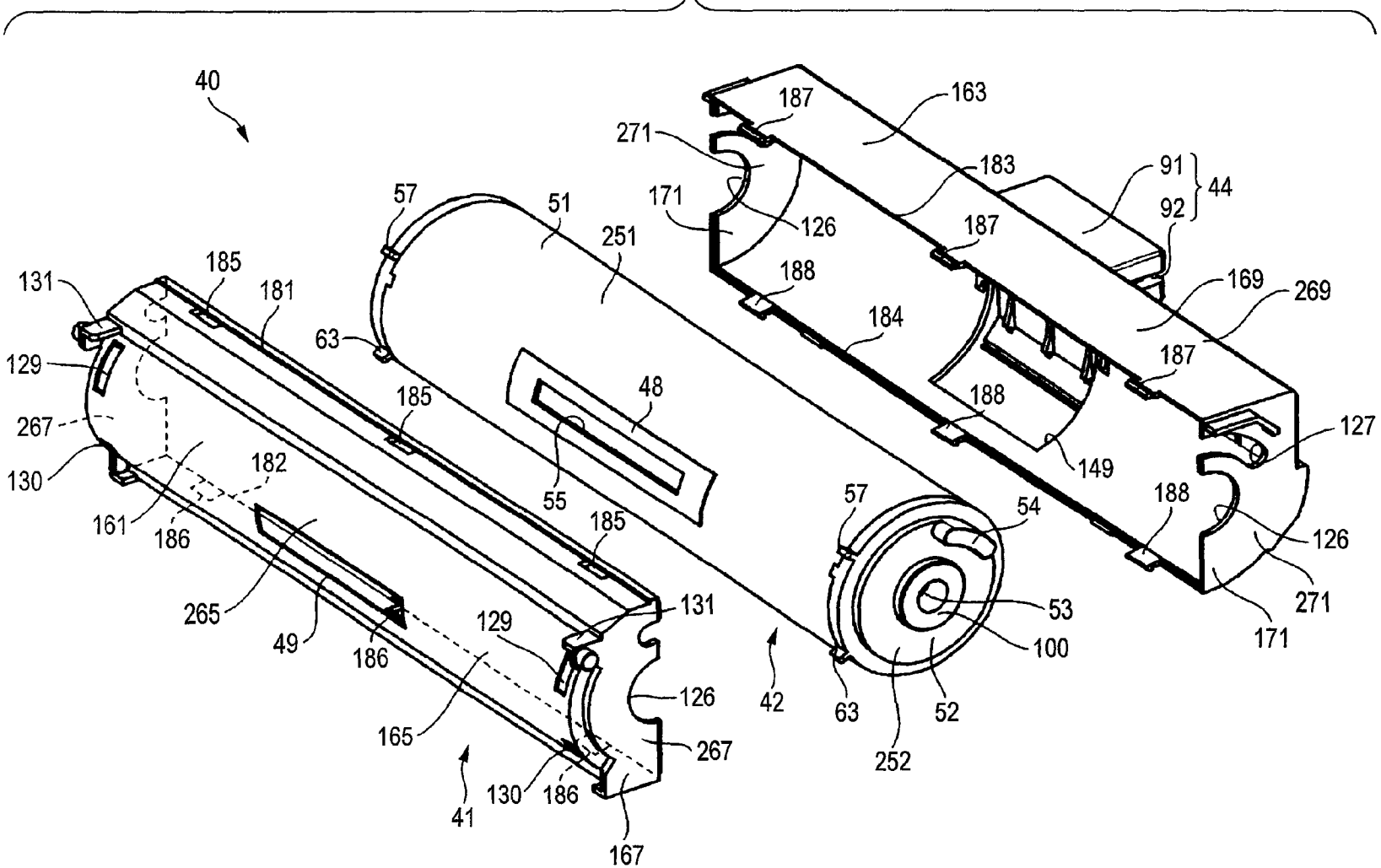
FIG. 6 is a schematic perspective view of the developer container of FIG. 5.

As shown in FIG. 6, the inner housing 42 has a substantially hollow cylindrical shape that is longitudinal in the width direction, that is, in the shaft direction (hereinafter, also referred to as shaft direction) of an agitator rotation shaft 53 to be described later. The inner housing 42 includes a first cylinder portion 51 extending in the shaft direction and a pair of first end portions 52 extending in the direction perpendicular to the shaft direction at both ends in the shaft direction of the first cylinder portion 51.

The first cylinder portion 51 has an inner circumferential wall 251 as an example of the first cylinder wall having a substantially cylinder shape. The first end portions 52 have a substantially flat disc shape and have an inner end wall 252 as an example of the first end wall closing the ends of the inner circumferential wall 251 in the width direction. As shown in FIG. 3, an agitator rotation shaft 53 is suspended at the centers of the inner end walls 252 opposed to each other in the width direction. The agitator rotation shaft 53 is rotatably supported by the inner end walls 252. An agitator 56 as an example of the agitating member is disposed in the agitator rotation shaft 53. A wiper 50 is disposed in the agitator 56. The wiper 50 is made of rubber and is fitted to both ends of the agitator rotation shaft 53 in the shaft direction (width direction).

As shown in FIG. 6, both ends of the agitator rotation shaft 53 in the width direction protrude outward in the width direction from the inner end walls 252. A collar 100 as an example of the cylinder portion of which the outer diameter is slightly smaller than the diameter of the second insertion hole 126 of the outer housing 41 is fitted to the protruding portions of the agitator rotation shaft 53.

At positions outside the agitator rotation shaft 53 in the diameter direction and opposed to each other in the width direction in the inner end walls 252, widthwise protrusions 54, as an example of the second protrusions, protruding outward in the width direction are formed. The widthwise protrusions 54 have a substantially arc shape in a side view.

At a position on the circumference at the center in the width direction of the inner circumferential wall 251, specifically, at a position different by about 90° counterclockwise from the widthwise protrusion 54 in a left side view, a second developer discharge port 55 (see FIG. 3) as an example of the first opening penetrating the inner circumferential wall 251 in the thickness direction is formed.

The inner circumferential wall 251 is provided with a sealing member 48 attached to protrude outward in the diameter direction along the circumferential edge of the second developer discharge port 55. The sealing member 48 has a substantially rectangular frame shape as viewed from the outside in the diameter direction and is formed of an elastic material such as rubber or a sponge sheet.

At both ends of the inner circumferential wall 251 in the width direction, second diameter-wise protrusions 57 protruding outward in the diameter direction are disposed at a position slightly above the upper edge of the sealing member 48. At both ends of the inner circumferential wall 251 in the width direction, third diameter-wise protrusions 63 protruding outward in the diameter direction are disposed at a position slightly below the lower edge of the sealing member 48. The second diameter-wise protrusions 57 and the third diameter-wise protrusions 63 have a same size as each other and the lengths thereof in the width direction are smaller than the groove widths of the upper guide groove 129 and the lower guide groove 130 of the outer housing 41. The second diameter-wise protrusions 57 and the third diameter-wise protrusions 63 are an example of the first protrusions.

As shown in FIG. 3, a fourth diameter-wise protrusion 99 protruding outward in the diameter direction and extending in the width direction is formed at a position of the inner circumferential wall 51 opposite to the second developer discharge port 55 about the shaft of the inner housing 42.

In a state where the developer container 40 is not attached to the process unit 20, the fourth diameter-wise protrusion 99 has a function of engaging with a first engaging portion 132 of a first regulating portion 94 of the outer housing 41 to regulate the revolution of the inner housing 42 relative to the outer housing 41.

(b-3-ii) Outer Housing

Figure 5:
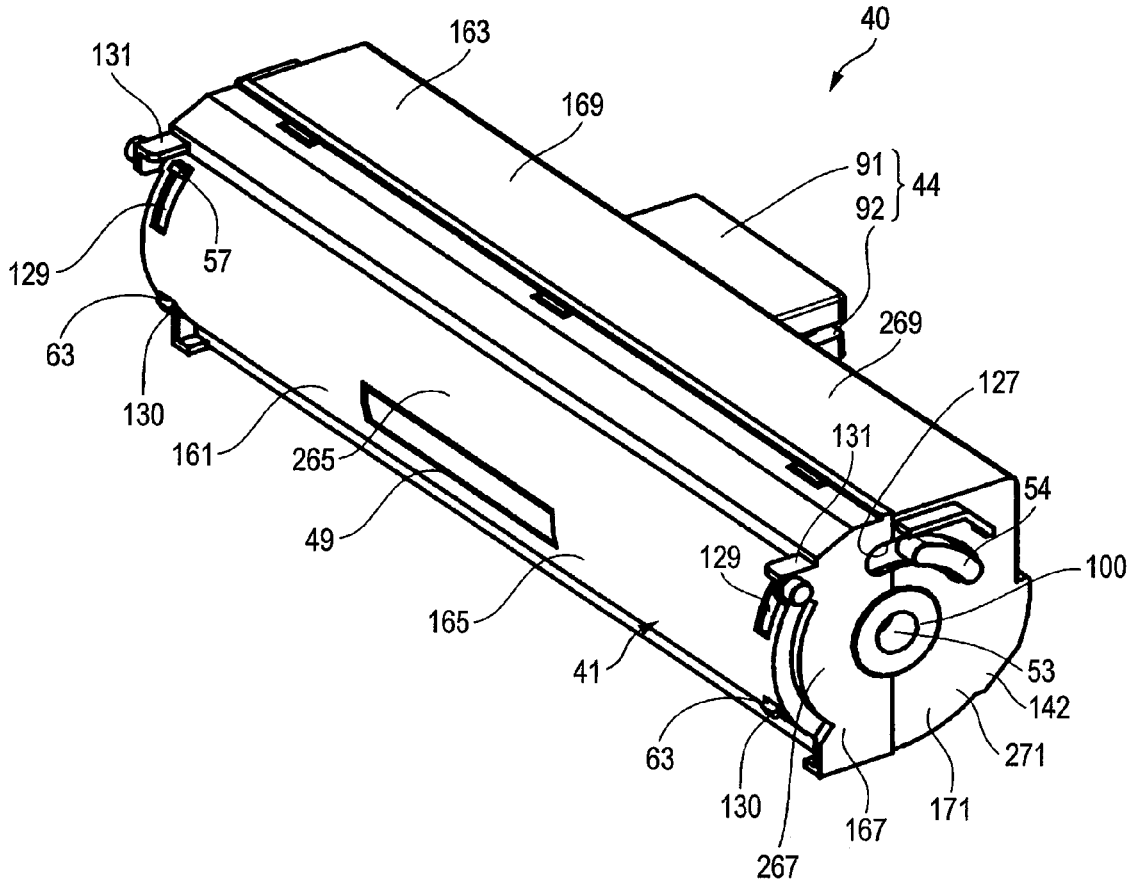
FIG. 5 is an exemplary left perspective view of the developer container of the process unit of FIG. 2, according to an illustrative aspect of the present invention, as viewed from an upper back side.

Referring to FIGS. 5 and 6, the outer housing 41 has a substantially σ shape in a left side view of the developer container 40 and includes a first cover member 161 and a second cover member 163 independent of the first cover member 161.

The first cover member 161 includes a first cover cylinder portion 165 extending along the first cylinder portion 51 of the inner housing 42 and a pair of first cover end portions 167 extending in the direction perpendicular to the shaft direction at both ends of the first cover cylinder portion 165 in the shaft direction.

As shown in FIGS. 5 and 6, the first cover cylinder portion 165 includes a first outer circumferential wall 265 as an example of the first cover cylinder wall that is longitudinal in the width direction and that is formed in a semi-cylinder shape which is a substantially rectangular shape in a side view. The first cover end portions 167 have first outer end walls 267 as an example of the first cover end walls which are both ends in the width direction of the first outer circumferential wall 265.

A first developer discharge port 49 as an example of the second opening which penetrates the first outer circumferential wall 265 in the thickness direction thereof is formed at the center position on the back surface of the first outer circumferential wall 265 in a vertical direction and a lateral direction. The first developer discharge port 49 has a substantially rectangular shape which is longitudinal in the width direction. The first developer discharge port 49 has a substantially rectangular shape having substantially the same size as the second developer discharge port 55 of the inner housing 42 as viewed from the outside in the diameter direction.

In both end portions in the width direction of the back surface of the first outer circumferential wall 265, upper guide grooves 129 penetrating the first outer circumferential wall 265 in the thickness direction are formed above the developer discharge port 49. In both end portions in the width direction of the back surface of the first outer circumferential wall 265, lower guide grooves 130 penetrating the first outer circumferential wall 265 in the thickness direction are formed below the developer discharge port 49. The upper guide grooves 129 and the lower guide grooves 130 have a substantially rectangular shape which is longitudinal in the circumferential direction as viewed from the back side. The circumferential length thereof is about twice the circumferential length of the first developer discharge port 49 and the widthwise length thereof is about a half the circumferential length of the first developer discharge port 49. The upper guide grooves 129 and the lower guide grooves 130 are an example of the first hole. The length of the upper guide grooves 129 and the lower guide grooves 130 is greater than the second diameter-wise protrusion 57 and the third diameter-wise protrusion 63 in the circumferential direction, that is, in the rotation direction of the agitator 56.

Figure 7:
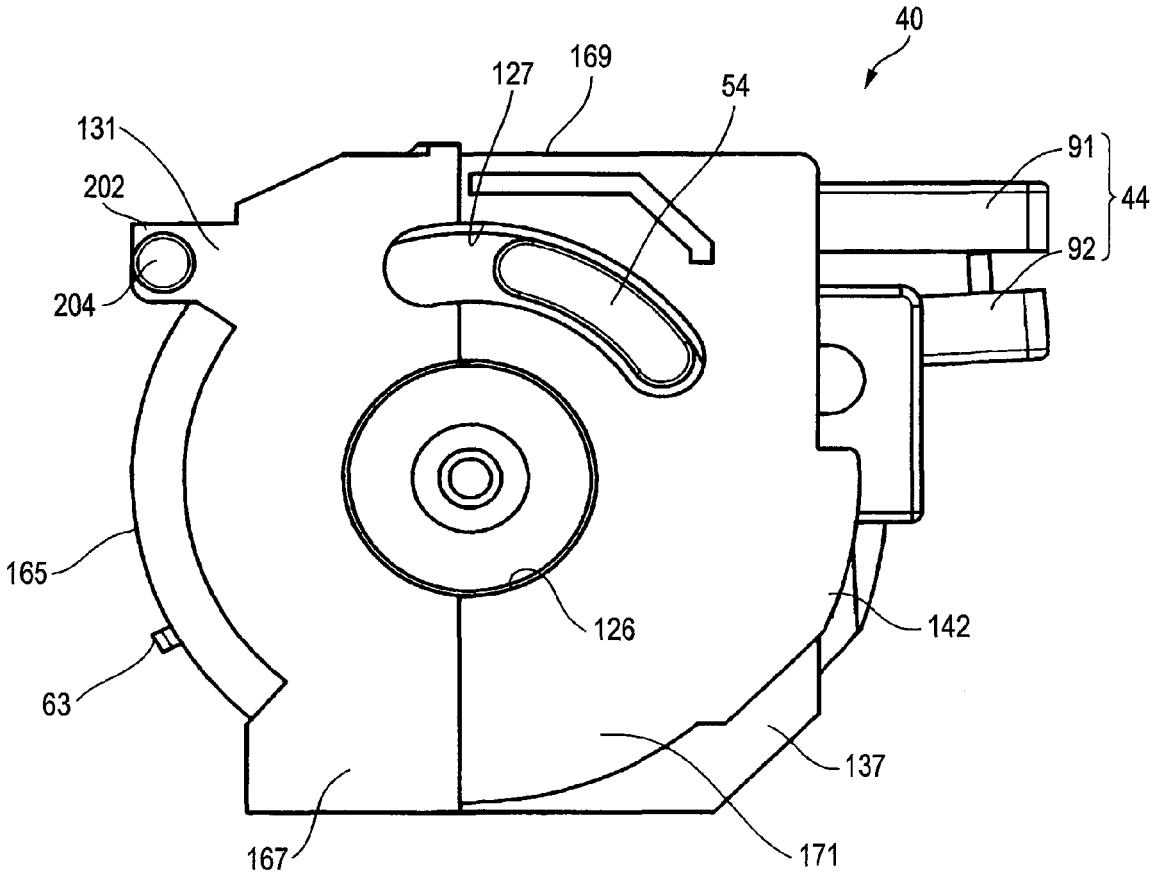
FIG. 7 is an exemplary left side view of the developer container of FIG. 5.

Positioning protrusions 131 as the protruding portions are integrally formed at boundaries between the first outer circumferential wall 265 and the first outer end walls 267. Referring to FIG. 7, the positioning protrusions 131 each have a base 202 extending backward from a position corresponding to the upper edge of the upper guide groove 129 and a free end 204 being bent and protruding outward in the width direction. The free end 204 has a substantially cylinder shape having an outer diameter smaller than the width of the guide groove 119 (see FIG. 4A) of the front housing 39 of the process unit 20.

As shown in FIG. 6, the first outer circumferential wall 265 includes a first upper edge portion 181 and a first lower edge portion 182 extending in the shaft direction at its vertical ends. Three upper engaging holes 185 are formed with a gap in the shaft direction to penetrate the first upper edge portion 181 in the thickness direction. Similarly to the first upper edge portion 181, three lower engaging holes 186 are formed with a gap in the shaft direction to penetrate the first lower edge portion 182. The first upper edge portion 181 and the first lower edge portion 182 are an example of the first edge portion. The upper engaging holes 185 and the lower engaging holes 186 are an example of the inactive engaging portion. The upper engaging holes 185 and the lower engaging holes 186 may have a substantially concave shape.

The second cover member 163 includes a second cover cylinder portion 169 extending along the first cylinder portion 51 of the inner housing 42 and a pair of second cover end portions 171 extending in the direction perpendicular to the shaft direction at both ends of the second cover cylinder portion 169 in the shaft direction.

As shown in FIGS. 5 and 6, the second cover cylinder portion 169 includes a second outer circumferential wall 269 as an example of the second cover cylinder wall that is longitudinal in the width direction and that has a semi-cylinder shape which is a substantially rectangular shape in a side view. The second cover end portions 171 have second outer end walls 271 as an example of the second cover end walls which are both ends in the width direction of the second outer circumferential wall 269.

As shown in FIG. 8, below the front surface of the second outer circumferential wall 269, positioning ribs 137 as an example of the extending portion are formed at positions apart outward from the center in the width direction by a distance corresponding to about ¼ of the width of the second outer circumferential wall 269. The positioning ribs 137 have a thin plate shape having an isosceles trapezoidal shape in a side view, which continuously extends downward from the upper half portion of the front surface of the second outer circumferential wall 269, which is bent and extends to the lower back side, which is bent again and extends backward to be continuous to the lower half portion of the lower surface of the second outer circumferential wall 269. The widthwise size of the positioning ribs 137 is slightly smaller than the width of the positioning grooves 138.

A protrusion exposing hole 149 is formed in a portion between the positioning ribs 137 on a lower side of the front surface of the second outer circumferential wall 269. The protrusion exposing hole 149 has a substantially rectangular shape and penetrates the second outer circumferential wall 269 in the thickness direction. The widthwise size of the protrusion exposing hole 149 is larger than the widthwise size of the fourth diameter-wise protrusion 99 (see FIG. 3) of the inner housing 42.

Inactive contact members 142 as an example of the extending portion are disposed at both ends in the width direction on the lower side of the front surface of the second outer circumferential surface 269. The inactive contact members 142 are formed in a substantially arc shape in a left side view which protrudes forward from the front surface of the second outer circumferential wall 269. The widthwise size thereof is substantially equal to the widthwise size of the contact protrusions 141 of the switching lever 113. The front surface of the inactive contact members 142 includes a guide surface 146 and an inactive contact surface 147. The guide surface 146 extends flat to the upper front side in the left side view and is curved convex to the front side in the middle. The inactive contact surface 147 extends continuously from the upper edge of the guide surface 146 and protrudes in front of the convex curved portion of the guide surface 146. A plurality of inactive portions 144 having a substantially concave shape to the back side is disposed in the circumferential direction (rotation direction of the agitator 56) in the inactive contact surface 147. Specifically, the inactive contact portions 144 are recessed in a substantially semi-spherical shape.

As shown in FIG. 6, the second outer circumferential wall 269 includes a second upper edge portion 183 and a second lower edge portion 184 extend in the shaft direction at its vertical ends. In the second upper edge portion 183, three upper engaging claws 187 have a substantially convex shape protruding outward with a gap in the shaft direction. In the second lower edge portion 184, similarly to the second upper edge portion 183, three lower engaging claws 188 have a substantially convex shape with a gap in the shaft direction. When the first cover member 161 and the second cover member 163 are fitted to each other, the upper engaging claws 187 can engage with upper engaging holes 185 formed at corresponding positions and the lower engaging claws 188 can engage with lower engaging holes 186 formed at corresponding positions.

The upper edge portion 183 and the second lower edge portion 184 are an example of the second edge portion. The upper engaging claws 187 and the lower engaging claws 188 are an example of the engaging portion.

The second cover member 163 includes a guide lever 44 as an example of the grip portion.

The guide lever 44 is disposed at the center in the width direction in the upper end portion of the front surface of the second outer circumferential wall 269 and includes a developer container grip portion 91 as an example of the first grip member and a pivoting portion 92 as an example of the second grip member.

The developer container grip portion 91 has a substantially rectangular shape in a plan view which is longitudinal in the width direction and the back end portion thereof is fixed to the second outer circumferential wall 269 as shown in FIG. 3. The developer container grip portion 91 includes a first grip portion 201 as the first protruding plate which has a substantially rectangular shape in a plan view.

The pivoting portion 92 has a substantially rectangular shape in a plan view and a substantially T shape in a side sectional view and integrally includes a second grip portion 93 as the second protruding plate and a first regulating portion 94 and a second regulating portion 95 as the engaging plate.

The second grip portion 93 and the second regulating portion 95 have a substantially rectangular shape in a plan view. The second grip portion 93 is opposed to the first grip portion 201 in the vertical direction.

The first regulating portion 94 extends in a direction perpendicular to the second grip portion 93 and has a rectangular shape in a front view and has a substantially J shape in a left sectional view. A first engaging portion 132 and a second engaging portion 133 are formed sequentially from the upside at the lower end of the first regulating portion 94. The first engaging portion 132 is formed as a groove extending in the width direction so that the back surface of the lower end of the first regulating portion 94 is recessed to the front side. Below the first engaging portion 132, the second engaging portion 133 has a substantially hook shape in the left sectional view in which the lowermost end of the first regulating portion 94 is slightly curved to the back side.

The back end of the second grip portion 93, the upper end of the first regulating portion 94, and the front end of the second regulating portion 95 are connected to each other. A shaft insertion hole 96 penetrating the second grip portion 93 and the first regulating portion 94 in the width direction is formed at the connecting position between the back end of the second grip portion 93 and the first regulating portion 94.

A pair of shaft supporting portions 98 protruding forward with the second grip portion 93 of the pivoting portion 92 interposed therebetween are integrally formed on the front surface of the second outer circumferential wall 269. The insertion shaft 37 as the shaft member suspended between the pair of shaft supporting portions 98 are inserted into the shaft insertion hole 96 of the pivoting portion 92, whereby the pivoting portion 92 is pivotally supported by the second outer circumferential wall 269.

The back end of the developer container grip portion 91 and the second regulating portion 95 of the pivoting portion 92 are connected to each other through an elastic member 128. Specifically, the elastic member 128 is a leaf spring or the like, one end of which is screwed to the back end of the developer container grip portion 91 with a screw (not shown) and the other end is locked to the second regulating portion 95. Accordingly, the pivoting portion 92 is always urged in the clockwise direction about the insertion shaft 37 with the urging force of the elastic member 128 so that the second regulating portion 95 gets close to the developer container grip portion 91.

The first outer end wall 267 and the second outer end wall 271 are provided with a second insertion hole 126 as an example of the supporting portion and an insertion groove 127 as an example of the second hole, as shown in FIGS. 5, 6, and 7.

The second insertion hole 126 is formed substantially at the center in the vertical and horizontal directions in a state where the first outer end wall 267 and the second outer end wall 271 are combined. The second insertion hole 126 are formed over the first outer end wall 267 and the second outer end wall 271 and penetrates the first outer end wall 267 and the second outer end wall 271 in the width direction. The second insertion holes 126 are formed in the first outer end walls 267 and the second outer end walls 271 at both ends in the width direction.

The insertion groove 127 is disposed outside the second insertion hole 126 in the diameter direction thereof in the state where the first outer end wall 267 and the second outer end wall 271 are combined. More specifically, the insertion groove 127 has a substantially arc shape coaxial with the second insertion hole 126 from a twelve o'clock position to a two o'clock position in the left side view. The insertion groove 127 is formed over the first outer end wall 267 and the second outer end wall 271 and penetrate the first outer end wall 267 and the second outer end wall 271 in the width direction. The insertion groove 127 is formed in the first outer end wall 267 and the second outer end wall 271 at both ends in the width direction, similarly to the second insertion hole 126. The circumferential length of the insertion groove 127 is about twice the circumferential length of the widthwise protrusion 54 of the inner housing 42 and the width in the diameter direction thereof is slightly greater than the length in the diameter direction of the widthwise protrusion 54.

(b-2-iii) Attachment of Inner Housing to Outer Housing

In the above-described developer container 40, as shown in FIG. 6, the inner housing 42 is inserted between the first cover member 161 and the second cover member 163 of the outer housing 41 in the direction perpendicular to the shaft direction, that is, in the front and back directions. Both ends in the width direction of the agitator rotation shaft 53 of the inner housing 42 are inserted into the second insertion holes 126 of the first cover member 161 and the second cover member 163 along with the above-described collar 100. The widthwise protrusions 54 of the inner housing 42 are made to protrude outward in the width direction from the insertion grooves 127 of the outer housing 41. The second diameter-wise protrusions 57 of the inner housing 42 are made to protrude outward in the diameter direction of the inner housing 42 from the upper guide grooves 129 of the outer housing 41. The third diameter-wise protrusions 63 of the inner housing 42 are made to protrude outward in the diameter direction of the inner housing 42 from the lower guide grooves 130 of the outer housing 41. The fourth diameter-wise protrusion 99 of the inner housing 42 is exposed from the protrusion exposing hole 149 of the outer housing 41. The upper engaging claws 187 of the second cover member 163 are made to engage with the upper engaging holes 185 of the first cover member 161. The lower engaging claws 188 of the second cover member 163 are made to engage with the lower engaging holes 186 of the first cover member 161.

Accordingly, as shown in FIG. 5, the inner housing 42 is fitted to the outer housing 41, and the inner housing 42 is pivotally supported by the outer end walls 46 of the outer housing 41. Accordingly, the widthwise protrusions 54 are slidable along the insertion grooves 127, the second diameter-wise protrusions 57 are slidable along the upper guide grooves 129, and the third diameter-wise protrusions 63 are slidable along the lower guide groove 130.

In the developer container 40 fitted in this way, when the developer container grip portion 91 and the pivoting portion 92 are grasped together, the pivoting portion 92 pivots about the insertion shaft 37 against the urging force of the elastic member 128 so as to separate from the inner housing 42. When the engagement of the first engaging portion 132 with the fourth diameter-wise protrusion 99 is released by the operation of the developer container grip portion 91 and the pivoting portion 92, the rotation of the inner housing 42 relative to the outer housing 41 is enabled. In this case, when the inner housing 42 is made to revolve relative to the outer housing 41, as shown in FIG. 5, the widthwise protrusions 54 are guided into the insertion grooves 127, the second diameter-wise protrusions 57 are guided into the upper guide grooves 129, and the third diameter-wise protrusions 63 are guided into the lower guide grooves 130. When the inner housing 42 revolves relative to the outer housing 41, as shown in FIG. 3, the sealing member 48 of the inner housing 42 comes in slidable contact with the inner surface of the first outer circumferential wall 265 of the outer housing 41, and thus the space between the outer housing 41 and the inner housing 42 is kept air tight and liquid tight.

The inner housing 42 can rotate to a developer closing position where the second developer discharge port 55 of the inner circumferential wall 251 is closed at an area other than the first developer discharge port 49 of the first outer circumferential wall 265 of the outer housing 41 to close the inside of the outer housing 41 and the inside of the inner housing 42. In such a case, the second diameter-wise protrusions 57 come in contact with the upper edges of the upper guide grooves 129, the third diameter-wise protrusions 63 come in contact with the upper edges of the lower guide grooves 130, and the widthwise protrusions 54 come in contact with the front edges of the insertion grooves 127. On the other hand, the inner housing 42 can rotate to a developer opening position where the first developer discharge port 49 and the second developer discharge port 55 are opposed to each other to open the inside of the outer housing 41 and the inside of the inner housing 42. In this case, the second diameter-wise protrusions 57 come in contact with the lower edges of the upper guide grooves 129, the third diameter-wise protrusions 63 come in contact with the lower edges of the lower guide grooves 130, and the widthwise protrusions 54 come in contact with the back edge of the insertion grooves 127.

The inner housing 42 contains developer. In the image forming apparatus 1 according to this exemplary embodiment of the present invention, the developer comprises a suspension polymerization toner which is a nonmagnetic one-component toner with positive electrification.

A coloring agent such as a carbon black or wax may be blended into the developer. Additives such as silica may be added thereto to improve the fluidity.

(b-4) Attachment and Detachment of Developer Container to and from Process Unit (b-4-i) Attachment of Developer Container to Process Unit As shown in FIG. 8, in a state where the switching lever 113 is located at the release position and the shutter 111 is located at the developer closing position, the developer container 40 in which the inner housing 42 is located at the developer closing position is attached to the developer container housing chamber 71 of the process unit 20 from the upper front side to the lower back side. The positioning protrusions 131 of the developer container 40 are guided into the guide grooves 119 in the developer container housing chamber 71 of the process unit 20.

When the positioning protrusions 131 reach and contact the deepest portion of each guide groove 119, the widthwise protrusions 54 of the developer container 40 engage with the receiving portions 117 of the switching lever 113 located at the release position. The second diameter-wise protrusions 57 of the developer container 40 engage with the inactive engaging portions 139 of the shutter 111 of the developer container housing chamber 71 and the shutter 111 is interposed between the second diameter-wise protrusions 57 and the third diameter-wise protrusions 63 in its rotating direction.

The positioning ribs 137 of the developer container 40 are fitted into the positioning grooves 138 of the process unit 20. Accordingly, the outer housing 41 of the developer container 40 is positioned relative to the developer container housing chamber 71 and thus the attachment of the developer container 40 to the process unit 20 is completed. In this state, the handle portion 118 of the switching lever 113 located at the release position is downward and spaced apart by a gap from the developer container grip portion 91 of the developer container 40. The contact portions of the contact protrusions 141 of the process unit side grip portion 110 come in slight contact with the guide surfaces 146 of the corresponding inactive contact members 142 of the developer container 40.

In a state where the attachment of the developer container 40 to the process unit 20 is completed, the engagement of the first engaging portion 132 and the fourth diameter-wise protrusion 99 is released, and thus the inner housing 42 can freely revolve relative to the outer housing 41. Accordingly, when the switching lever 113 is made to rotate from the release position to the contact position (see FIG. 2), the inner housing 42 revolves from the developer closing position (see FIG. 5) to the developer opening position (see FIG. 3) with the revolving of the switching lever 113. Therefore, as shown in FIG. 3, the first developer discharge port 49 and the second developer discharge port 55 are opposed to each other. The shutter 111 interposed between the second diameter-wise protrusions 57 and the third diameter-wise protrusions 63 of the inner housing 42 revolves from the developer closing position (see FIGS. 4B and 8) to the developer opening position (see FIGS. 3 and 4A) with the revolving of the inner housing 42, whereby the through hole 112 of the shutter 111 is opposed to the developer introduction port 88 of the developer container housing chamber 71. Since the process unit side grip portion 110 revolves upward with the revolving of the switching lever 113 from the release position to the contact position, the handle portion 118 moves adjacent to the developer container grip portion 91.

In the developer container housing chamber 71 in which the shutter 111 is located at the developer opening position and the developer container 40 in which the inner housing 42 is located at the developer opening position, the through hole 112 and the developer introduction port 88, which are opposed to each other in the developer container housing chamber 71, face the first developer discharge port 49 and the second developer discharge port 55, which are opposed to each other in the developer container 40. Accordingly, the inside of the developer container 40 and the inner housing 42 may communicate with the inside of the developing chamber 72 of the developing section 30 through the developer introduction port 88, the through hole 112, the first developer discharge port 49, and the second developer discharge port 55.

As described above, the sealing member 48 creates an air and liquid tight seal between the outer housing 41 having the first developer discharge port 49 formed therein and the inner housing 42 having the second developer discharge port 55 formed therein. The sealing member 125 is interposed between the shutter 111 having the through hole 112 formed therein and the curved wall 122 having the developer introduction port 88 formed therein. Accordingly, the external leakage of the developer from the developer introduction port 88, the through hole 112, the first developer discharge port 49, and the second developer discharge port 55 is prevented.

As described above, when the process unit side grip portion 110 rotates with the revolution of the switching lever 113 from the release position to the contact position, the contact portions of the contact protrusions of the process unit side grip portion 110 pass through the guide surface 146 of the inactive contact member 142, rotate upward along the inactive contact surface 147, and move over the plural inactive contact portions 144.

(b-4-ii) Detachment of Developer Container from Process Unit

In a state where the shutter 111 is located at the developer opening position and the inner housing 42 is located at the developer opening position, the switching lever 113 located at the contact position is made to rotate to the release position, as shown in FIG. 4B. Accordingly, with the revolving of the switching lever 113, the inner housing 42 rotates from the developer opening position to the developer closing position and the second developer discharge port 55 of the inner circumferential wall 51 is closed in an area other than the first developer discharge port 49 in the outer circumferential wall 45 of the outer housing 41, thereby closely sealing the inside of the outer housing 41 and the inside of the inner housing 42. Since the second diameter-wise protrusions 57 and the third diameter-wise protrusions 63 also rotate with the rotation of the inner housing 42, the shutter 111 interposed between the second diameter-wise protrusions 57 and the third diameter-wise protrusions 63 rotates from the developer opening position to the developer closing position. Accordingly, the developer introduction port 88 of the developer container housing chamber 71 is closed in an area other than the through hole 112 of the shutter 111.

Since the process unit side grip portion 110 rotates downward with the rotation of the switching lever 113 to the release position, the contact portion of the process unit side grip portion 110 moves over the plural inactive contact portions 144 and rotates downward along the inactive contact surface 147.

In the state where the switching lever 113 rotates to the release position, the second engaging portions 133 engage with the inactive engaging portions 124. Accordingly, the engagement of the second engaging portions 133 with the inactive engaging portions 124 is released by grasping the developer container grip portion 91 and the pivoting portion 92. The developer container 40 is drawn to the upper front side out of the developer container housing chamber 71 with the pivoting portion 92 grasped. Accordingly, the positioning protrusions 131 (see FIG. 8) of the developer container 40 are guided into the guide grooves 119 (see FIG. 8) in the developer container housing chamber 71.

As shown in FIG. 8, when the positioning protrusions 131 are detached from the guide grooves 119 to disengage the widthwise protrusions 54 and the receiving portions 117 from each other and to disengage the second diameter-wise protrusions 57 and the inactive engaging portions 139 from each other, the detachment of the developer container 40 from the process unit 20 is completed. At this time, when force is removed from the withdrawn developer container 40, the first engaging portion 132 engages with the fourth diameter-wise protrusion 99.

(b-5) Developing and Transfer Operations

As described in (b-4-i) and as shown in FIG. 3, when the developer container 40 is attached to the process unit 20 and is housed in the developer container housing chamber 71 and then an image forming operation is performed by the image forming apparatus 1, the driving force from a motor (not shown) is applied to the agitator rotation shaft 53. Then, the agitator rotation shaft 53 rotates in the clockwise direction in the left side view and the agitator 56 circumferentially moves inside the inner housing 42 of the developer container 40 about the agitator rotation shaft 53. Then, the developer in the developer container 40 is agitated by the agitator 56, is supplied to the developing section 30 through the second developer discharge port 55 and the first developer discharge port 49, is received through the through hole 112 and the developer introduction port 88, and is discharged to the developing chamber 72. The above-described wipers 50 of the agitator 56 wipe a developer detecting window (not shown) disposed in the inner end walls 252 of the inner housing 42 with the revolving of the agitator rotation shaft 53. Accordingly, the developer detecting window (not shown) is sensed and cleaned by the wipers.

The developer discharged from the developer introduction port 88 into the developing chamber 72 is supplied to the developing roller 104 with the rotation of the feed roller 101 and is positively frictionally charged between the feed roller 101 and the developing roller 104. With the rotation of the developing roller 104, the developer supplied to the developing roller 104 enters a space between the pressing portion 148 of the thickness regulating blade 107 and the rubber roller 106 of the developing roller 104 and is carried as a thin layer having a constant thickness on the developing roller 104.

The surface of the photosensitive drum 28 is positively uniformly charged by the scorotron-type charger 29 with the rotation of the photosensitive drum 28 and is exposed by a high speed scanning of laser beams from the scanner unit 19, thereby forming an electrostatic latent image corresponding to an image to be formed on the sheet 3.

Then, when the developer carried on the developing roller 104 and charged positively comes in contact with the photosensitive drum 28 with the rotation of the developing roller 104, the developer is supplied to the electrostatic latent image formed on the surface of the photosensitive rum 28. Accordingly, the electrostatic latent image on the photosensitive drum 28 is visualized and a developer image resulting from the inverted developing is carried on the photosensitive drum 28.

Thereafter, the developer image carried on the surface of the photosensitive drum 28 is conveyed by the register roller 15 (see FIG. 1) and is transferred onto the sheet 3 with the transfer bias applied to the transfer roller 31 while the sheet 3 entering the drum housing 76 passes a transfer position between the photosensitive drum 28 and the transfer roller 31.

The sheet 3 onto which the developer image is transferred is discharged out of the drum housing 76 and is conveyed to the fixing unit 21.

The transfer residual developer remaining on the photosensitive drum 28 after the transfer is collected by the developing roller 104.

(c) Fixing Unit

As shown in FIG. 1, the fixing unit 21 is disposed in the back of the process unit 20 with a horizontal gap from the photosensitive drum 28 of the process unit 20. The fixing unit 21 includes a fixing frame 59 and a heating roller 60 and a pressing roller 61 which are both disposed in the fixing frame 59.

The fixing unit 21 thermally fixes the developer image transferred onto the sheet 3 at the transfer position while the sheet 3 passes through the space between the heating roller 60 and the pressing roller 61. The sheet 3 to which the developer image is fixed is conveyed along the discharge conveying passage to the sheet discharging roller 47 by the conveying roller 63, and then is discharged onto the sheet discharge tray 58 by the sheet discharging roller 47. The sheet discharge tray 58 is formed on the top surface of the body casing 2.

In this illustrative aspect, the first cover member 161 covering the back side of the inner housing 42 and the second cover member 163 covering the front side of the inner housing 42 are provided individually in the direction perpendicular to the shaft direction. Accordingly, even when the area with which the outer housing 41 covers the inner housing 42 is great, it is possible to easily assemble the developer container 40. Accordingly, it is possible to easily manufacturing the developer container 40, while maintaining the strength of the developer container 40.

(Second Illustrative Aspect)

Figure 9:
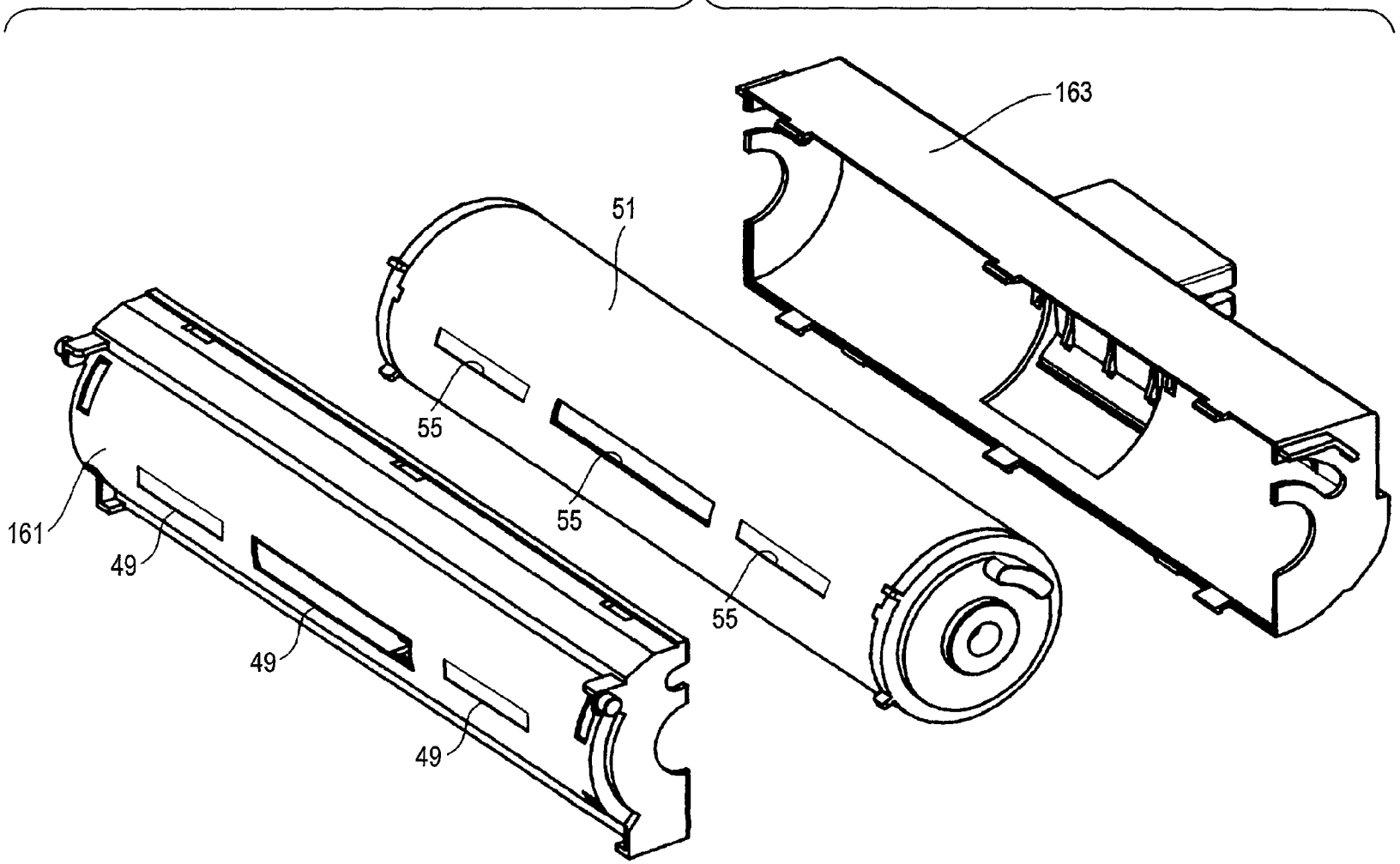
FIG. 9 is a schematic perspective view of a developer container, according to another illustrative aspect of the present invention, showing a modified example of a developer discharge port.

In the first illustrative aspect, the second developer discharge port 55 of the inner housing 42 is disposed at one position on the circumference at the center in the width direction of the inner circumferential wall 51 and the first developer discharge port 49 of the outer housing 41 is disposed at the vertical and horizontal center on the back surface of the first outer circumferential wall 265. However, as shown in FIG. 9, the second developer discharge port 55 and the first developer discharge port 49 may be formed in a plural number in the width direction. In FIG. 9, a second illustrative aspect of the present invention is shown in which three second developer discharge ports 55 and three first developer discharge ports 49 are disposed.

(Third Illustrative Aspect)

Figure 10:
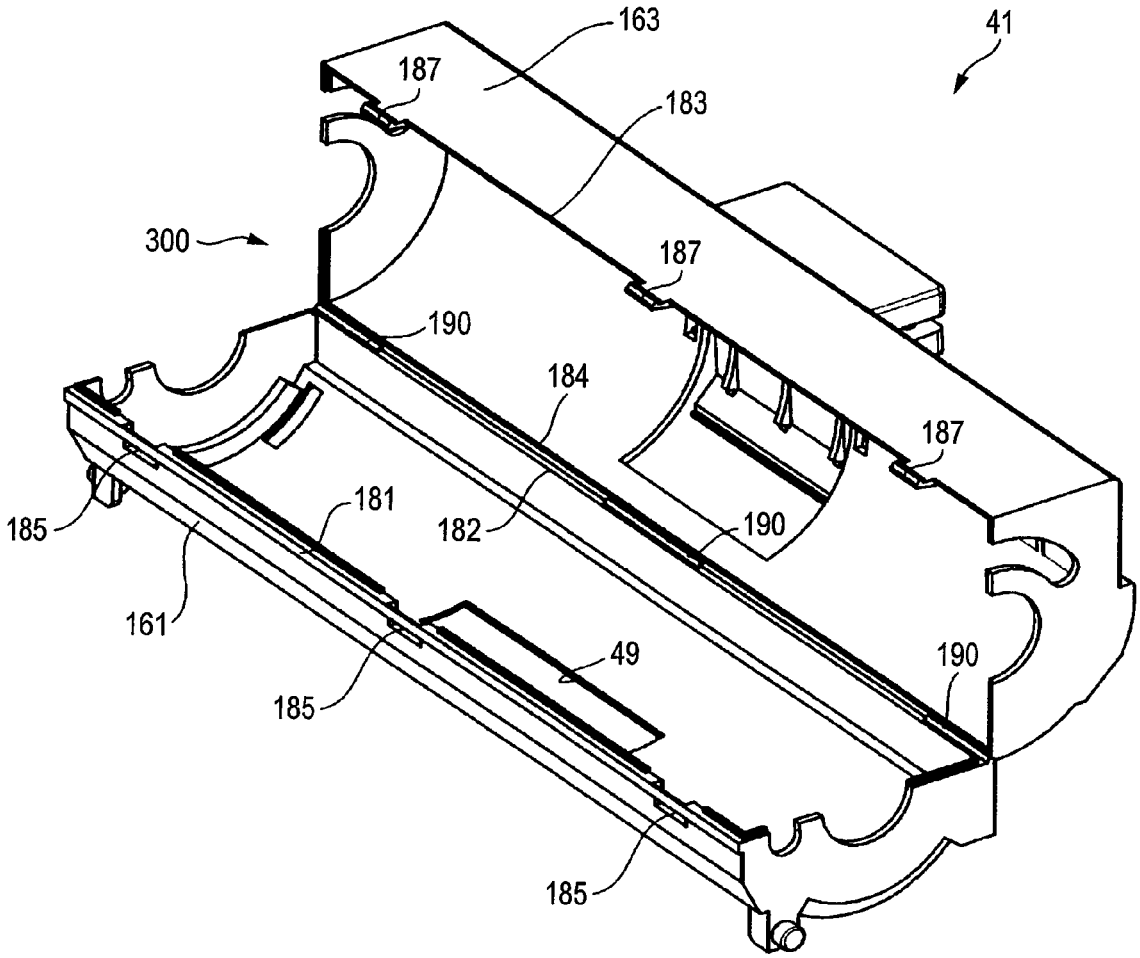
FIG. 10 is an exemplary perspective view of a developer container, according to another illustrative aspect of the present invention, showing a modified example of an outer housing of the developer container.

Although in the first illustrative aspect described above the first cover member 161 and the second cover member 163 are individually provided in the outer housing 41, the invention is not limited thereto as long as it is possible to easily manufacture the developer container 40 while maintaining the strength of the developer container. FIG. 10 is a perspective view illustrating a modified example of the outer housing 41 according to a third illustrative aspect. In this illustrative aspect, the outer housing 41 has the housing section 300 formed therein as an example of the housing section for housing the inner housing 42. That is, as shown in FIG. 10, the first lower edge portion 182 of the first cover member 161 and the second lower edge portion 184 of the second cover member 163 are connected to each other by the use of a plurality of connecting portions 190. For example, three connection portions 190 are shown in FIG. 10. Accordingly, the first cover member 161 and the second cover member 163 may be made to pivot about the connecting point of the connecting portions 190, thereby opening and closing the housing section 300. Moreover, although three connecting portions 190 are shown in FIG. 10, it is also possible to provide one connecting portion extending the width of the outer housing 41. In the developer container 40 according to the third illustrative aspect, the inner housing 42 is placed into the second cover member 163 and the housing section 300 is closed by operating the first cover member 161 with respect to the connecting portions 190. The developer container 40 is attached by allowing the upper engaging claws 187 disposed in the second upper edge portion 183 to engage with the upper engaging holes 185 disposed in the first upper edge portion 181.

(Fourth Illustrative Aspect)

In the above-described illustrative aspects, the second insertion holes 126 are formed to penetrate the first outer end wall 267 and the second outer end wall 271 in the width direction. However, the second insertion holes may be formed in any other method so long as they can support the collar 100. For example, according to a fourth illustrative aspect of the present invention, a substantially concave shape which does not penetrate the first outer end wall 267 and the second end wall 271 in the width direction can be considered as such a configuration.

In the above-described illustrative aspects, the process unit 20 includes the drum section 27 and the developing section 30 in a bundle and the process unit 20 is detachably attached to the body casing 2. In addition, according to another illustrative aspect, the developing section 30 may be detachably attached to the drum section 27.

While the present invention has been shown and described with reference to certain illustrative aspects thereof, it will be understood by those skilled in the art that various changes in form and details may be made therein without departing from the spirit and scope of the invention as defined by the appended claims.

What is claimed is:

1. A developer container comprising:

a first housing that accommodates an agitating member and that has a substantially cylindrical shape along a shaft of the agitating member; and a second housing that covers the first housing and is rotatable around the shaft of the agitating member relative to the first housing, wherein the first housing comprises:

a first cylinder portion that extends along the shaft of the agitating member and that has a first opening; and a first end portion that extends substantially perpendicular to the shaft of the agitating member at both ends of the first cylinder portion, wherein the second housing comprises:

a first cover member that covers a part of the first housing in a direction perpendicular to the shaft of the agitating member; and a second cover member that is separated from the first cover member and covers a remaining part of the first housing in the direction perpendicular to the shaft of the agitating member, wherein the first cover member comprises:

a first cover cylinder portion that extends along the first cylinder portion and that has a second opening corresponding to the first opening; and a first cover end portion provided at each end of the first cover cylinder portion, the first cover end portion extending in the direction perpendicular to the shaft of the agitating member, wherein the first cover end portion comprises a first cover end wall that extends in the direction perpendicular to the shaft of the agitating member, and wherein the second cover member comprises:

a second cover cylinder portion that extends along the first cylinder portion; and a second cover end portion provided at each end of the second cover cylinder portion, the second cover end portion extending in the direction perpendicular to the shaft of the agitating member, wherein the second cover end portion comprises a second cover end wall that extends in the direction perpendicular to the shaft of the agitating member.

2. The developer container according to claim 1, wherein the first end portion comprises:

an end wall that extends in the direction perpendicular to the shaft of the agitating member; and a second protrusion that extends from the end wall along the shaft of the agitating member, and wherein the second housing further comprises a second hole that is formed in at least one of the first cover end wall and the second cover end wall and allows the second protrusion to pass through the second hole.

3. The developer container according to claim 2, wherein the second hole is continuous in the first cover end wall and the second cover end wall.

4. The developer container according to claim 2, wherein the second hole has a substantially arc shape, with a center of the arc centered on the shaft of the agitating member.

5. The developer container according to claim 4, wherein the second protrusion is smaller than the second opening in the rotation direction of the agitating member.

6. The developer container according to claim 1, wherein the first end portion comprises a cylindrical portion that extends along the shaft of the agitating member, and wherein the first cover end wall and the second cover end wall comprise a supporting portion that rotatably supports the cylindrical portion.

7. The developer container according to claim 1, wherein the first cylinder portion comprises a first cylinder wall that extends along the shaft of the agitating member, and wherein the second cover cylinder portion comprises:

a second cover cylinder wall that extends along the first cylinder wall; and a grip portion that is formed in the second cover cylinder wall.

8. The developer container according to claim 7, wherein the grip portion comprises:

a first grip member that protrudes radially outward from the second cover cylinder portion; and a second grip member that is disposed to be rotatable about the second cover cylinder portion, protrudes radially outward from the second cover cylinder portion, and confronts the first grip member.

9. The developer container according to claim 8, wherein the first grip member comprises a first protruding plate that extends along the shaft of the agitating member, and wherein the second grip member comprises:

a shaft member that is disposed to rotate about the second cover cylinder portion;

a second protruding plate that extends from the shaft member to one side and confronts the first protruding plate; and an engaging plate that extends from the shaft member to the other side perpendicular to the second protruding plate.

10. The developer container according to claim 7, wherein an extending portion that extends in a rotation direction of the agitating member is disposed at each end of the grip portion in a direction parallel to the shaft of the agitating member.

11. The developer container according to claim 1, wherein the first opening has a rectangular shape at the center of the first cylinder portion in the direction parallel to the shaft of the agitating member, and wherein the second opening has substantially the same shape as the first opening at the center of the first cover cylinder portion in the direction parallel to the shaft of the agitating member.

12. The developer container according to claim 11, wherein the first housing comprises a seal member that is disposed to surround the first opening and configured to prevent leakage of a developer between the first housing and the second housing.

13. The developer container according to claim 1, wherein the first cover cylinder portion comprises a protruding portion that protrudes outward from each end of the first cover cylinder portion in the direction parallel to the shaft of the agitating member, and wherein the protruding portion comprises:

a base that extends from the first cover cylinder portion in the direction perpendicular to the shaft of the agitating member; and a free end that extends from an end of the base in the direction parallel to the shaft of the agitating member.

14. The developer container according to claim 1, wherein the first cover cylinder portion comprises a first edge portion that extends along the shaft of the agitating member, wherein the second cover cylinder portion comprises a second edge portion that extends along the shaft of the agitating member and corresponds to the first edge portion, wherein the first edge portion comprises a first engaging portion, and wherein the second edge portion comprises a second engaging portion that engages with the first engaging portion.

15. The developer container according to claim 14, wherein the second engaging portion is one of a plurality of second engaging portions and the first engaging portion is one of a plurality of first engaging portions, and the plurality of second engaging portions and the plurality of first engaging portions are disposed in the direction parallel to the shaft of the agitating member.

16. The developer container according to claim 14, wherein the second engaging portion has a substantially convex shape and the first engaging portion has a substantially concave shape.

17. The developer container according to claim 1, wherein the first opening is one of a plurality of first openings and the second opening is one of a plurality of second openings, and the plurality of the first openings and the plurality of the second openings are disposed in a direction parallel to the shaft of the agitating member.

18. A developer container comprising:

a first housing that accommodates an agitating member and that has a substantially cylindrical shape along a shaft of the agitating member; and a second housing that covers the first housing and is rotatable around the shaft of the agitating member relative to the first housing, wherein the first housing comprises:

a first cylinder portion that extends along the shaft of the agitating member and that has a first opening; and a first end portion that extends substantially perpendicular to the shaft of the agitating member at both ends of the first cylinder portion, wherein the second housing comprises:

a first cover member that covers a part of the first housing in a direction perpendicular to the shaft of the agitating member; and a second cover member that is separated from the first cover member and covers a remaining part of the first housing in the direction perpendicular to the shaft of the agitating member, wherein the first cover member comprises:

a first cover cylinder portion that extends along the first cylinder portion and that has a second opening corresponding to the first opening; and a first cover end portion provided at each end of the first cover cylinder portion, the first cover end portion extending in the direction perpendicular to the shaft of the agitating member, wherein the second cover member comprises:

a second cover cylinder portion that extends along the first cylinder portion; and a second cover end portion provided at each end of the second cover cylinder portion, the second cover end portion extending in the direction perpendicular to the shaft of the agitating member, wherein the first cylinder portion comprises:

a first cylinder wall that extends along the shaft of the agitating member; and a first protrusion that extends in the direction perpendicular to the shaft of the agitating member from the first cylinder wall, and wherein the first cover cylinder portion comprises:

a first cover cylinder wall that extends along the first cylinder wall; and a first hole that is provided in the first cover cylinder wall and allows the first protrusion to pass through the first hole.

19. The developer container according to claim 18, wherein the first hole extends in the first cover cylinder wall along a rotation direction of the agitating member.

20. The developer container according to claim 19, wherein the first protrusion is smaller than the first hole in the rotation direction of the agitating member.

21. The developer container according to claim 18, wherein the first protrusion is one of a plurality of first protrusions, and the plurality of first protrusions are disposed at each end in the direction parallel to the shaft of the agitating member.

22. A developer container comprising:

a first housing that comprises an agitating member and that has a substantially cylindrical shape along a shaft of the agitating member; and a second housing that comprises a housing section for housing the first housing and is rotatable around the shaft of the agitating member relative to the first housing, wherein the first housing comprises:

a first cylinder portion that has a first opening formed therein and that extends along the shaft of the agitating member; and a first end portion that extends perpendicular to the shaft of the agitating member at each end of the first cylinder portion, wherein the second housing comprises:

a first cover member that covers a part of the first housing in a direction perpendicular to the shaft of the agitating member; and a second cover member that covers a remaining part of the first housing in the direction perpendicular to the shaft of the agitating member, wherein the first cover member comprises:

a first cover cylinder portion that has a second opening corresponding to the first opening and the second opening extends along the first cylinder portion; and a first cover end portion that extends in the direction perpendicular to the shaft of the agitating member at each end of the first cover cylinder portion, wherein the first cover end portion comprises a first cover end wall that extends in the direction perpendicular to the shaft of the agitating member, wherein the second cover member comprises:

a second cover cylinder portion that extends along the first cylinder portion; and a second cover end portion that extends in the direction perpendicular to the shaft of the agitating member at each end of the second cover cylinder portion, wherein the second cover end portion comprises a second cover end wall that extends in the direction perpendicular to the shaft of the agitating member, wherein the first cover cylinder portion comprises a first edge portion that extends along the shaft of the agitating member, wherein the second cover cylinder portion comprises a second edge portion that extends along the shaft of the agitating member and is connected to the first edge portion, and wherein the first cover member and the second cover member are configured to open and close about the first housing.

23. The developer container according to claim 22, wherein the first end portion comprises a cylindrical portion that extends along the shaft of the agitating member, and wherein the first cover end wall and the second cover end wall comprise a supporting portion that rotatably supports the cylindrical portion.

* * * * *